US005706876A

United States Patent [19]

Lysyj

[11] Patent Number: 5,706,876

[45] Date of Patent: Jan. 13, 1998

[54] CORDLESS, ROLLER BAR CELLULAR SHADE

[76] Inventor: Phillip A. Lysyj, 8136 Thornhurst Dr., N. Royalton, Ohio 44133

[21] Appl. No.: 681,910

[22] Filed: Jul. 29, 1996

[51] Int. Cl.[6] ..... E06B 3/94

[52] U.S. Cl. ..... 160/84.05; 160/170 R

[58] Field of Search ..... 160/84.01, 84.02, 160/84.03, 84.04, 84.05, 84.06, 107, 98, 170 R, 171 R

[56] References Cited

U.S. PATENT DOCUMENTS

| | | | |
|---|---|---|---|
| 13,251 | 7/1855 | Bixler . | |
| 927,090 | 7/1909 | Anderson . | |
| 948,239 | 2/1910 | Mc Manus . | |
| 1,636,601 | 7/1927 | Givens . | |
| 1,731,124 | 10/1929 | Carper . | |
| 2,037,393 | 4/1936 | Roberts . | |
| 2,049,518 | 8/1936 | Schier | 160/84.04 |
| 2,110,983 | 3/1938 | Carver | 160/84.04 |
| 2,260,101 | 10/1941 | De Falco | 160/84.04 |
| 2,266,160 | 12/1941 | Burns . | |
| 2,276,716 | 3/1942 | Cardona . | |
| 2,324,536 | 7/1943 | Pratt . | |
| 2,325,992 | 8/1943 | Wirthman . | |
| 2,350,094 | 5/1944 | Butts . | |
| 2,390,826 | 12/1945 | Cohn . | |
| 2,410,549 | 11/1946 | Olson . | |
| 2,420,301 | 5/1947 | Cusumano . | |
| 2,598,887 | 6/1952 | Burns | 160/170 R |
| 2,687,769 | 8/1954 | Gershuny . | |
| 2,824,608 | 2/1958 | Etten . | |
| 2,874,612 | 2/1959 | Luboshez . | |
| 3,371,700 | 3/1968 | Romano | 160/84.01 |
| 3,485,285 | 12/1969 | Anderle . | |
| 3,487,875 | 1/1970 | Shukat et al. | 160/84.01 |
| 3,817,309 | 6/1974 | Takazawa | 160/84.01 |
| 4,157,108 | 6/1979 | Donofrio . | |
| 4,205,816 | 6/1980 | Yu | 160/84.01 X |
| 4,223,714 | 9/1980 | Weinreich et al. . | |
| 4,326,577 | 4/1982 | Tse . | |
| 4,344,474 | 8/1982 | Berman . | |
| 4,398,585 | 8/1983 | Marlow . | |
| 4,574,864 | 3/1986 | Tse . | |
| 4,610,292 | 9/1986 | Hausmann et al. . | |
| 4,625,786 | 12/1986 | Carter et al. . | |
| 4,647,488 | 3/1987 | Schnebly et al. | 160/84.06 X |
| 4,726,410 | 2/1988 | Fresh . | |
| 4,852,627 | 8/1989 | Peterson et al. . | |
| 4,862,941 | 9/1989 | Colson . | |
| 4,877,075 | 10/1989 | Markowitz . | |
| 4,880,045 | 11/1989 | Stahler . | |
| 4,984,617 | 1/1991 | Corey . | |
| 5,083,598 | 1/1992 | Schon | 160/84.02 |
| 5,133,399 | 7/1992 | Hiller et al. . | |
| 5,141,041 | 8/1992 | Katz et al. . | |
| 5,313,998 | 5/1994 | Colson et al. . | |
| 5,320,154 | 6/1994 | Colson et al. . | |
| 5,445,204 | 8/1995 | van der Wielen . | |
| 5,482,100 | 1/1996 | Kuhar . | |
| 5,485,875 | 1/1996 | Genova . | |

*Primary Examiner*—David M. Purol
*Attorney, Agent, or Firm*—Frank J. Nawalanic

[57] ABSTRACT

A cordless, cellular window shade uses a conventional roller shade bar with a spring pawl arrangement to raise and lower the cellular, window covering fabric by at least two wide, transversely spaced tapes extending from the head rail of the shade through slits in the cellular fabric and secured to the bottom rail of the shade. Each tape has periodically spaced, alignment openings along its length which engage circumferentially spaced, spokes protruding from the roller shade bar to precisely wind the tape about the roller shade bar as the shade is raised or lowered and thus maintain the bottom rail in parallel relationship with the low profile, head rail.

34 Claims, 6 Drawing Sheets

CORDLESS, ROLLER BAR CELLULAR SHADE

This invention relates generally to window shades and more particularly to window shades where the window covering is a pleated fabric such as cellular type shades.

The invention is particularly applicable to and will be described with specific reference to a cellular window shade which is manually operable with a mechanical spring but which doesn't employ pull cords, sashes and the like. Those skilled in the art will understand that the invention can also be applied to other fabric type shades such as pleated shades, Roman shades or balloon shades and the invention may have broader application and could be used in applications where a motorized drive is substituted for a spring.

BACKGROUND OF THE INVENTION

Manually operated, window shades or coverings presently in wide scale commercial use can be classified as as either cord type or cordless.

Cord type arrangements are universally used today to operate Venetian blinds, cellular shades, pleated shades, thermally insulated shades, Roman and balloon type shades. In all of these shade arrangements, no less than two cords (or a single looped cord) hang from the side of the shade and extend into a head rail which carries some form of pulley arrangement. The pulley arrangement attaches to a set (typically two or three) of draw cords or strings which extends through openings in the blind or shade and attaches to the bottom rail. Pulling the side cords shorten the draw strings so that the bottom rail draws against the head rail and in the process folds or pleats the shade or blind. Lateral movement of the side cords locks and unlocks the pulley so that the weight of the shade or blind will cause the shade or blind to lower. If the lower rail is uneven, pulling one of the side cords shortens one of the draw strings to bring the bottom rail even. (Venetian blinds typically have a wand on the opposite side of the head rail and additional draw strings so that rotation of the wand causes the individual slats to open or close.) There are countless locks and lock mechanism combinations in existence.

Even though mass production techniques have reduced the price, the cord type arrangement is relatively expensive and typically requires installation by trained installers. The cords hanging down from sides of the shades are aesthetically unpleasing, especially so in window installations where several windows are adjacent one another. The most serious drawback, however, is the safety hazard caused by the dangling cords. The industry has recognized this problem as evidenced by U.S. Pat. No. 5,133,399 to Hiller, 5,485,875 to Genova and the earlier U.S. Pat. No. 3,485,285 to Anderle.

The old fashioned, conventional roller shade bar window shade is universally accepted as the cordless window shade of choice. It is low cost and installed by the homeowner or end user and does away with the problems of a cord. Because the shade must roll onto itself over the shade roller bar, it can not be used for Venetian blinds, cellular shades, pleated shades, thermally insulated shades, Roman and balloon type shades. Furthermore, many of these applications have window covering weights which exceed the spring tension generated in conventional roller shade bar springs.

The prior art has attempted to develop cordless applications for such shades. The cordless prior art, in turn, can be viewed as falling within one of three different design approaches or classifications.

In the first approach, spring or motor driven pulley arrangements are arranged at the sides of the shades. The shades are basically raised and lowered by rollers in tracks mounted on the side of the window not entirely dissimilar to how a garage door opens and closes. See for example U.S. Pat. Nos. 5,141,041 to Katz et. al; 4,880,045 to Stahler and 4,862,941 to Colson. For side guides see also, U.S. Pat. Nos. 4,625,786 to Carter et. al; 4,398,585 to Marlow; 2,325,992 to Wirthman and 948,239 to McManus. In U.S. Pat. No. 2,324,536 to Pratt a spring on the support rod provides tension for raising and lowering the Venetian blind by moving the bottom rail through tapes outboard of the slats contained in enclosed side columns. In this approach, the side rails simply make such devices cost prohibitive and unwieldily except for special applications.

The second approach can be summarized as comprising a special pulley/spring arrangement mounted in the head rail. This design approach is typified by the designs disclosed in U.S. Pat. Nos. 5,482,100 to Kuhar and 5,133,399 to Hiller et. al which in turn are variations of U.S. Pat. No. 2,420,301 to Cusumano which in turn is a variation of U.S. Pat. No. 13,251 to Bixler (1855). See also U.S. Pat. No. to 2,410,549 to Olson for a slightly different application. The conceptual approach appears sound. The mechanisms and cost are simply more expensive than what is otherwise possible. Further, the headrail profile in many of these applications is bulky and aesthetically unappealing.

The last approach or classification which appears the most similar to the present invention utilizes the conventional roller spring in a roller shade bar to raise and lower the shade. However, the arrangements are somewhat cumbersome and unwieldily and will not operate consistently.

In the last category can be placed the designs disclosed in U.S. Pat. Nos. 2,037,393 to Roberts; 2,266,160 to Burns; 2,276,716 to Cardona; and 2,824,608 to Etten. All the references disclose Venetian blinds having a conventional ratchet pawl spring mechanism in which a cord or a thin tape within the ladder tapes straddling the slats are would onto a sheave attached to the roller bar for raising and lowering the blind. In Letten the cord is outboard. In Roberts the ladder tape itself is wound through pulleys onto the rod and the ladder tape has notches for engaging a mechanism for changing the vertical orientation of the slats held by the ladder tape. As will be discussed in further detail hereafter, the weight of the slats of Venetian blinds, even considering today's light weight mini-blind materials, make the choice of a conventional, ratchet/pulley spring mechanism unacceptable. To obtain a sufficiently strong spring which can be inserted inside a conventional roller shade bar, the diameter of the bar has to be significantly increased. Increasing the diameter of the roller bar means the head rail depth has to be increased accordingly and the resulting aesthetics would not be acceptable in today's home market. Apart from aesthetic considerations, the prior art could not maintain the bottom rail consistently parallel with the shade roller bar during repeated operation of the blind. In today's market a variation in alignment of the bottom rail as little as ¼ inch in a shade having a width as short as 36 inches will not be tolerated. While the prior art references could probably achieve this alignment, initially, inevitably misalignment caused by repeated shade use, will occur. Further, should the bottom rail move out of alignment, there is no way to adjust the blind to bring the bottom rail into alignment.

SUMMARY OF THE INVENTION

Accordingly, it is a principle object of the invention to utilize a conventional roller shade ratchet pawl spring arrangement for pleatable fabric shades, specifically cellular shades, which consistently maintains the bottom rail parallel with the shade roller bar (and the head rail) no matter how many times or how rapidly the shade is drawn and released.

This object along with other features of the invention is achieved in a cordless cellular roller shade which includes a head rail containing a roller shade bar having a spring extending therein with one end of the spring attached to a tension bar and the opposite end secured to a shade bar end cap. The shade bar end cap has a conventional ratchet pawl mechanism for tensioning the spring upon shade bar rotation in one direction and releasing spring tension to cause opposite shade bar rotation in a conventional manner. The shade includes a bottom rail adapted to be raised and lowered relative to the head rail and a pleated, cellular shade fabric conventionally formed of polygonal shapes arranged in a honeycomb matrix extends between the head rail and the bottom rail. At least first and second transversely spaced slits extend through the polygonal shapes from the bottom to the top of the cellular shade fabric for receiving first and second tapes secured to the bottom rail, repetitively. The roller shade bar has first and second transversely spaced spoke assemblies aligned with the first and second slits and upon which the top ends of the first and second tapes are secured, respectively. Importantly, each spoke assembly has a like plurality of spokes circumferentially spaced about and extending outwardly from the shade bar and the first and second tapes extend from the spoke assemblies through the first and second slits, respectively, to the bottom rail, with each tape having a plurality of alignment openings spaced along its length for engaging a spoke whereby each tape is precisely wound about its respective spoke assembly to consistently maintain the bottom rail in parallel relationship with the roller shade bar when the shade is raised or lowered to any position.

In accordance with an important feature of the invention, each spoke assembly includes a ring having a plurality of spokes extending therefrom and an alignment arrangement affixes each ring in a precise circumferential position onto the shade bar so that each spoke on each ring is transversely aligned with a corresponding spoke on the other ring while the spacing between alignment openings on each tape equals the circumferential distance between adjacent spokes. Significantly, the spacing is constant for a grouping of adjacent alignment openings equal in number to the number of the spokes and the spacing periodically increases for each successive grouping of alignment openings to account for the thickness of the tape as it is wound on each ring so that both tapes always wind on and pay out from each ring the same distance to maintain the bottom rail parallel to the roller shade bar irrespective of the force or the speed or the position at which the bottom rail is grasped to draw or release the shade.

In accordance with another important feature of the invention the head rail includes a U-shaped, open ended extrusion having a base with first and second transversely spaced slits receiving the first and second tapes, respectively, an end cap at each end of the head rail for receiving a roller shade support tip and a roller shade support having a cylindrically shaped base portion for rotatably supporting the roller shade bar whereby the shade is totally assembled and contained within an enclosed head rail which is simply and easily secured to a window frame by conventional brackets.

In accordance with a more specific feature of the invention the head rail has side rails vertically extending from its base to turned in top ends defining a transversely extending recess, and the shade support has side wall portions extending from the support's base portion with top ends which snap into (or are otherwise retained within) the head rail's top recess. The support's base portion has a central shade support cylindrical portion terminating in angular support portions extending to the support's side wall portions so that the angular support portions provide a spring bias for the support's cylindrical portion. In this manner and unlike conventional supports, the support's cylindrical portion resiliently supports the roller shade bar in a rotable manner if the shade is drawn down forcefully while permitting the roller shade bar to freely rotate when the shade is retracted.

It is an object of the invention to provide a cordless shade which can be used to raise or lower cellular shades, pleated shades, Roman and balloon type shades using a conventional roller shade bar equipped with a conventional roller shade spring mechanism.

It is another object of the invention to provide a cordless shade which maintains the bottom rail in perfect alignment notwithstanding the speed, the force or the position at which the bottom rail is grasped to raise or lower the shade.

Still another object of the invention is to provide a cordless shade, specifically a cordless cellular shade, which is aesthetically pleasing.

A still more specific object of the immediately foregoing object is to provide a cellular shade in which the lift mechanism for raising or lowering the shade maintains to a significant degree the color pattern of the cellular shade fabric, whether that color pattern be opaque or allow some portion of the light to diffuse through the shade fabric.

Another important object of the invention is to provide a cordless shade, specifically a cellular cordless shade, in which the head rail contains the entire mechanism for the shade and the head rail is totally enclosed so that the shade can be easily mounted by simply attaching brackets to the window frame which receives the head rail thus obviating the need for shade installers.

Still yet another object of the invention is to provide a cordless cellular, Roman, pleated or balloon type shade which uses conventional roller shade components to produce a simple and inexpensive shade which heretofore used relatively expensive pulley, cord type draw arrangements.

Yet another specific feature of the invention is to provide a cordless, cellular shade which is ideally suited for application as a shade to a multi-window treatment where a plurality of windows are mounted in frames side-by-side.

Still yet another specific but important object of the invention is to provide a cordless, cellular window shade which is characterized by having a low profile head rail for improved aesthetics and easy installation.

Still another object of the invention is to provide an integral head rail for a window shade containing end caps for supporting the shade roller bar as well as, for wide shade applications, bar supports which permit the bar to freely rotate with minimal friction.

A general object of the invention is to simply provide a low cost and reliable shade.

These and other objects of the invention will become apparent to those skilled in the art upon reading and understanding the Detailed Description of the invention set forth below.

BRIEF DESCRIPTION OF THE DRAWINGS

The invention may take physical form in certain parts and arrangements of parts a preferred embodiment of which will be described in detail and illustrated in the accompanying drawings which form a part hereof and wherein.

DETAILED DESCRIPTION OF THE INVENTION

Figure 1:
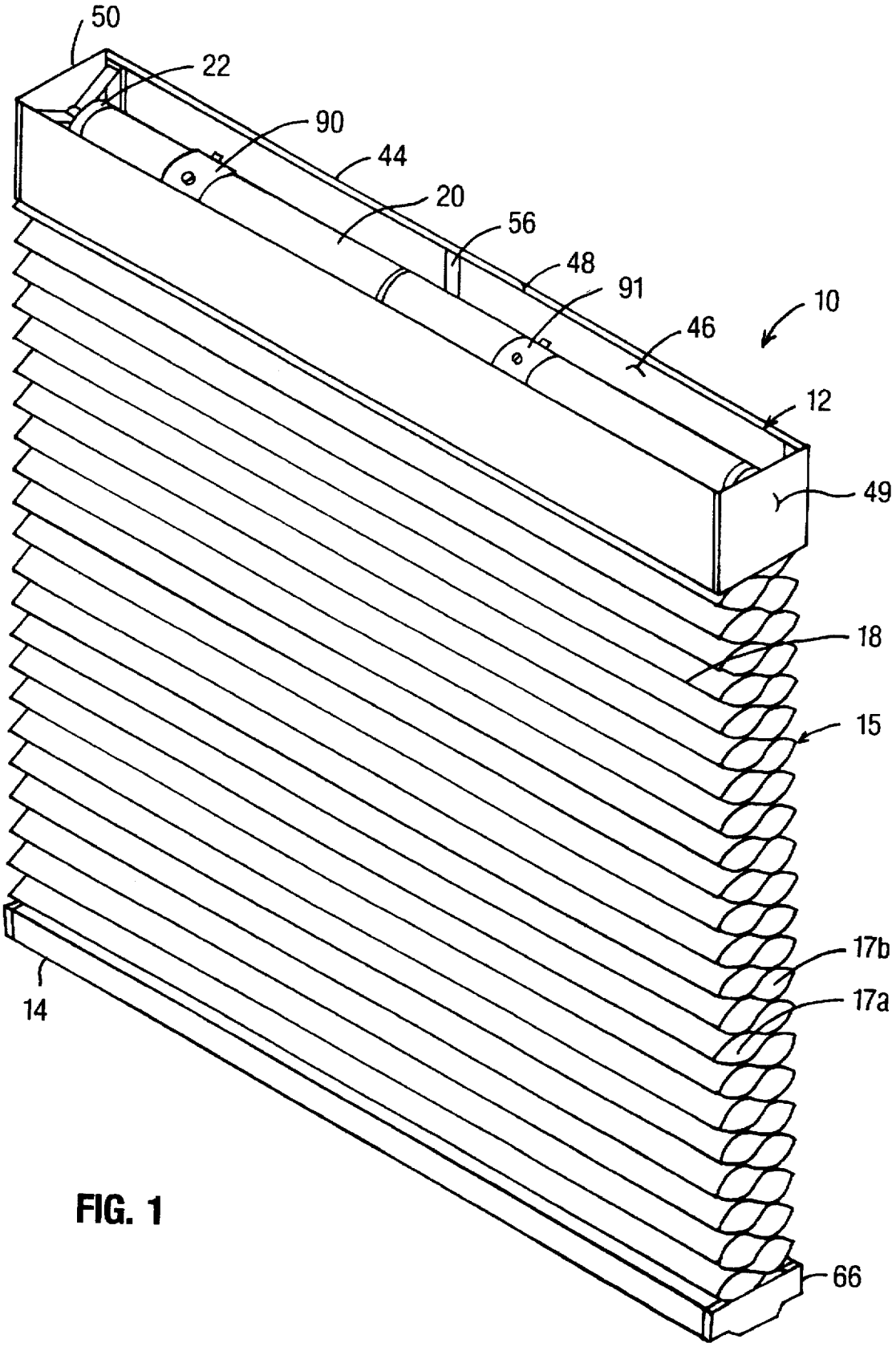
FIG. 1 is a perspective view of the shade of the present invention.
Figure 2:
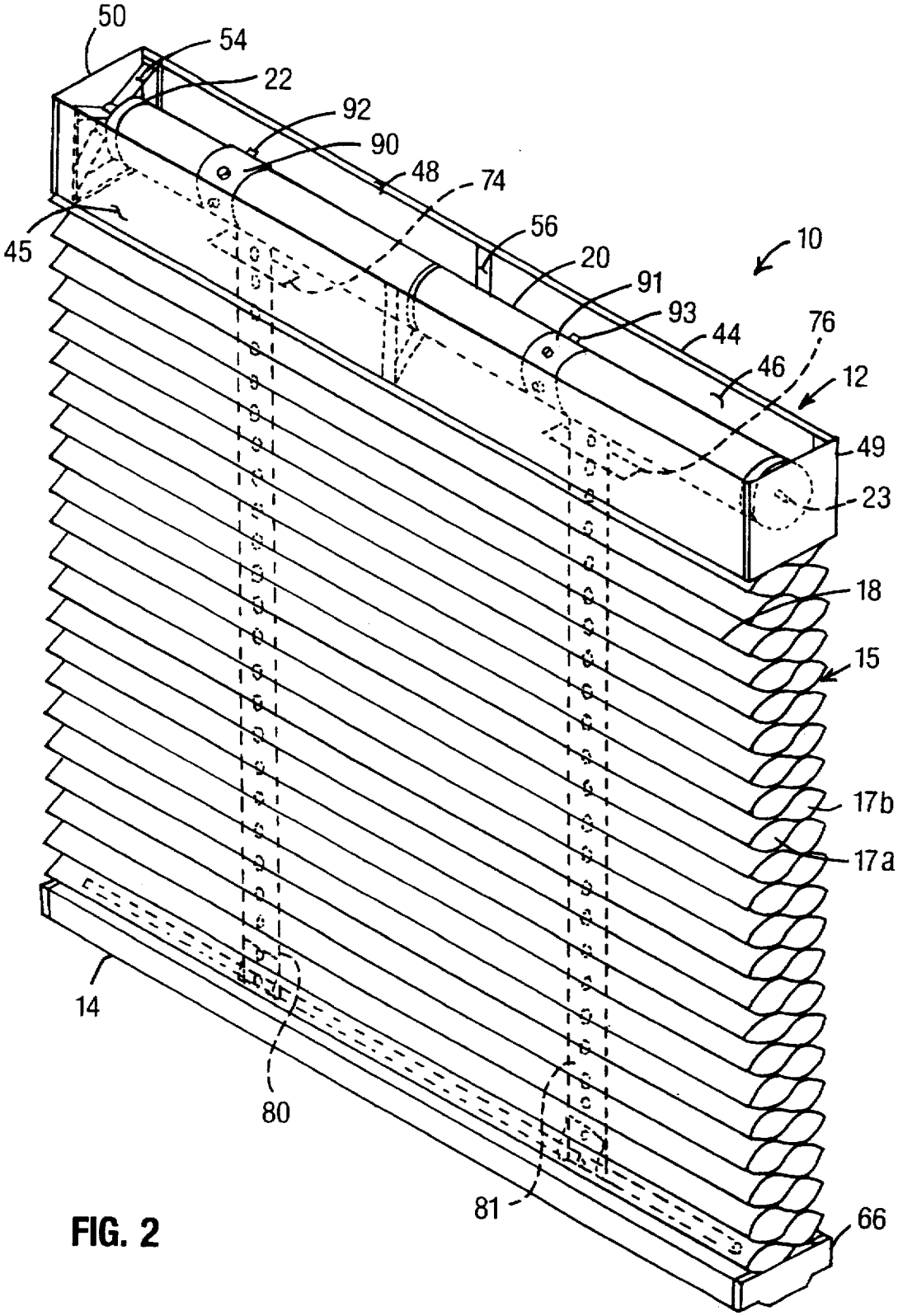
FIG. 2 is a perspective view of the shade of the present invention similar to FIG. 1 but showing the tape lift mechanism of the invention.

Referring now to the drawings wherein the showings are only for the purpose of illustrating a preferred embodiment of the invention and not for the purpose of limiting same, there is shown in FIGS. 1 and 2 an assembled, cordless window shade 10 of the present invention. Cordless shade 10 essentially comprises a head rail 12, a bottom rail 14, and a shade fabric 15.

In the preferred embodiment, shade fabric 15 is a cellular shade fabric. The invention was specifically developed as a cordless cellular shade and the invention has a particularly unique application as a cellular shade. Thus, in the preferred embodiment, shade fabric 15 can be viewed as comprising, in cross-sectional configuration, a plurality of polygonal cells 17 interconnected to vertically stack one on top the other to form a honeycomb pattern as illustrated when shade 10 is drawn so that shade fabric 15 covers the window (not shown). In the preferred embodiment, the honeycomb pattern includes two (2) rows of polygonal shapes designated as 17*a*, 17*b* for reasons which will be described below. Shade 10 is conventional in that it is opened or closed by moving bottom rail 14 downward or away from head rail 12 which is stationary and because shade 10 is cordless, the operator simply grasps bottom rail 14, preferably at its center, but anywhere along its length and moves it up or down. A tassel or a pull ring (not shown) can be applied or attached to the center of bottom rail 14 for pulling the shade downward if bottom rail is difficult to reach. In any event, when shade 10 is retracted, polygonal cell shape 17 collapses to form fabric plys indicated by transversely extending lines 18 in the drawings. Thus, the honeycomb pattern formed in the polygonal cell shape 17 expands and contracts like an accordion so that when shade fabric 15 is retracted, shade fabric 15 constitutes a series of vertically stacked plys 18 and when the shade is drawn, shade fabric 15 comprises a honeycomb matrix of polygonal shaped cells 17.

In a broader sense, it is contemplated that the invention can also be used with other types of shade fabrics and specifically those types of shade fabrics commonly referred to as pleated shades in which the shade fabric is pleated and simply opens and closes in an accordion like manner but without the formation of cells. It is also contemplated that the invention can be applied to Roman shades and balloon type shades in which the shade, when drawn closed, simply comprises a flat sheet covering the window. However, when the Roman shade is retracted, the fabric will fold back onto itself, and in a sense, the folds of the fabric can be viewed as plys for consistency in terminology.

Also, for consistency in terminology, when describing shade 10 as an assembled unit, "transverse" will mean the width of the shade assembly and "longitudinal" will mean the length of the shade extending in a vertical direction. However, when describing any particular part of shade 10, "length" or "longitudinal" will mean the longest dimension of the part.

Within head rail 10 is a totally conventional roller shade bar 20. In fact, the prototype was constructed using a standard 1⅛ inch diameter by 55½ inch length hollow, soft wood window shade roller purchased for $1.99. Roller shade bar 20 is furnished with end caps 22 and from one end cap extends a support tip stud 23 and from the other end cap extends a support tip blade 24 (shown in phantom in FIGS. 13–15). In fact, roller shade bar 20 in the preferred embodiment is a convolute bar or constructed of convoluted paper.

Figure 14:
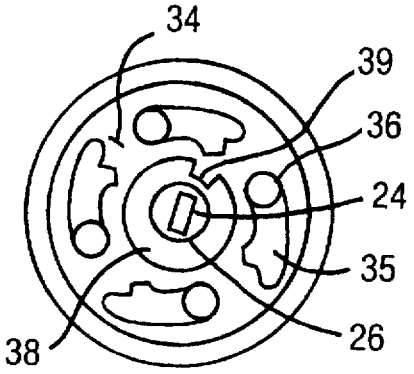
FIG. 14 is a sectioned view of the ratchet pawl mechanism used in the invention taken along lines 14—14 of FIG. 13 and is prior art.
Figure 15:
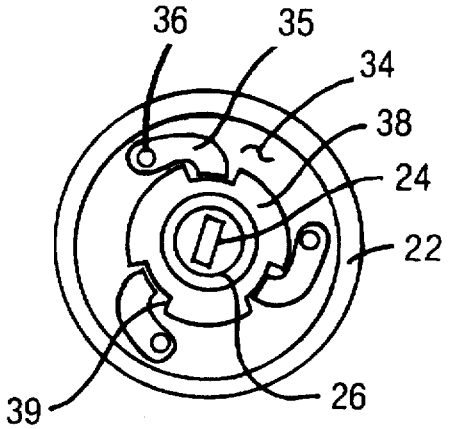
FIG. 15 is a sectioned view of another ratchet pawl mechanism similar to FIG. 14 and is prior art.
Figure 13:
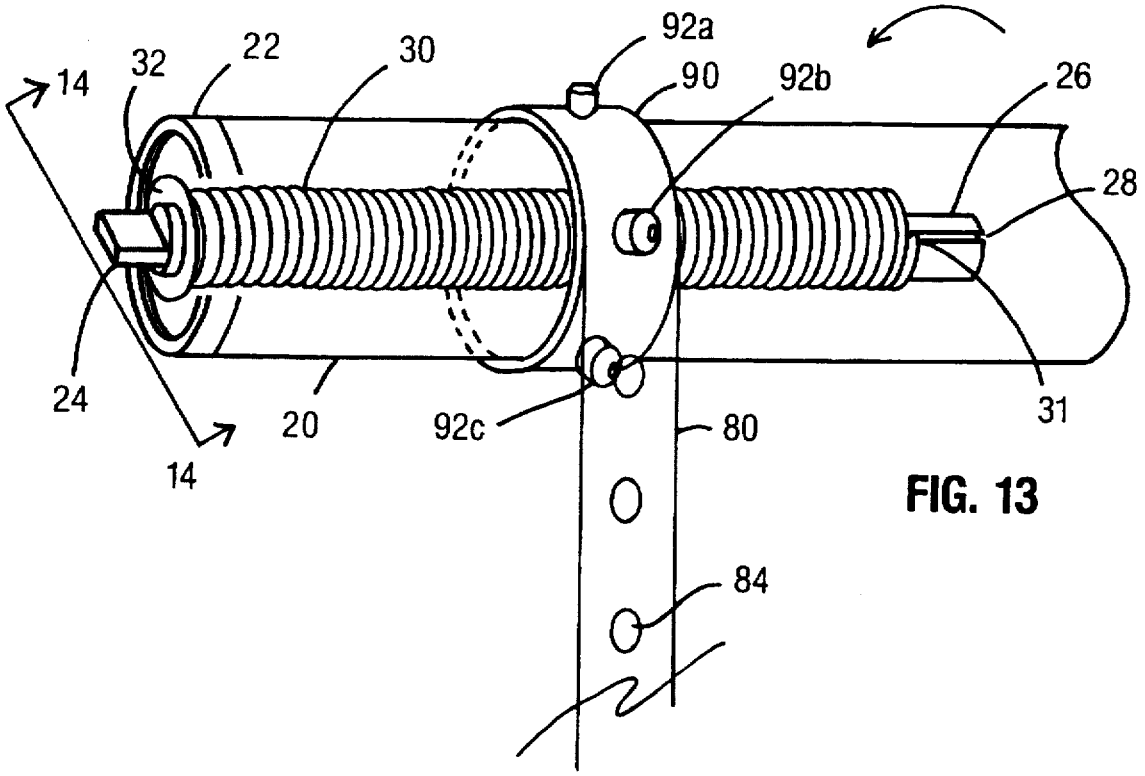
FIG. 13 is a partial, perspective view of the tape lift assembly similar to FIG. 4 but showing in phantom the spring mechanism.

Referring now to FIGS. 13–15, there is diagrammatically illustrated a conventional spring biased, ratchet/pawl arrangement supplied with conventional roller shade bar 20. In the arrangement illustrated, support tip blade 24 extends from or is made part of a spring rod 26 which extends some distance within roller shade bar 20 and has a slotted end 28. A longitudinally extending spring 30 fits over spring rod 26. One end 31 of spring 30 fits into slotted end 28 while the other spring end 32 is affixed to roller shade bar 20, usually to a pawl plate 34 which, in turn, is mounted to end cap 22 which in turn is press fitted onto roller shade bar 20. Because support tip blade 24 is non rotationally mounted in a bracket, spring rod 26 is stationary. Rotation of roller shade bar 20 thus tensions or compresses spring 30. A conventional ratchet pawl arrangement permits shade 10 to be drawn, locked and released in the conventional manner. Two typical, prior art ratchet pawl arrangements are shown in FIGS. 14 and 15 and both include a pawl plate 34 which carries pawl(s) 35 pivotally secured to pawl plate 34 by rivets 36. A ratchet plate 38 affixed to spring rod 26 has ratchet teeth 39 which mesh with pawls 35 to lock the shade in a drawn position with spring 30 tensioned and to permit the tension of spring 30 to conventionally rewind the shade fabric about roller shade bar 20 when pawls 35 are released from ratchet teeth 39. Again, roller shade bar 20 including end caps 24, and the ratchet pawl spring arrangement disclosed is entirely conventional.

Figure 3:
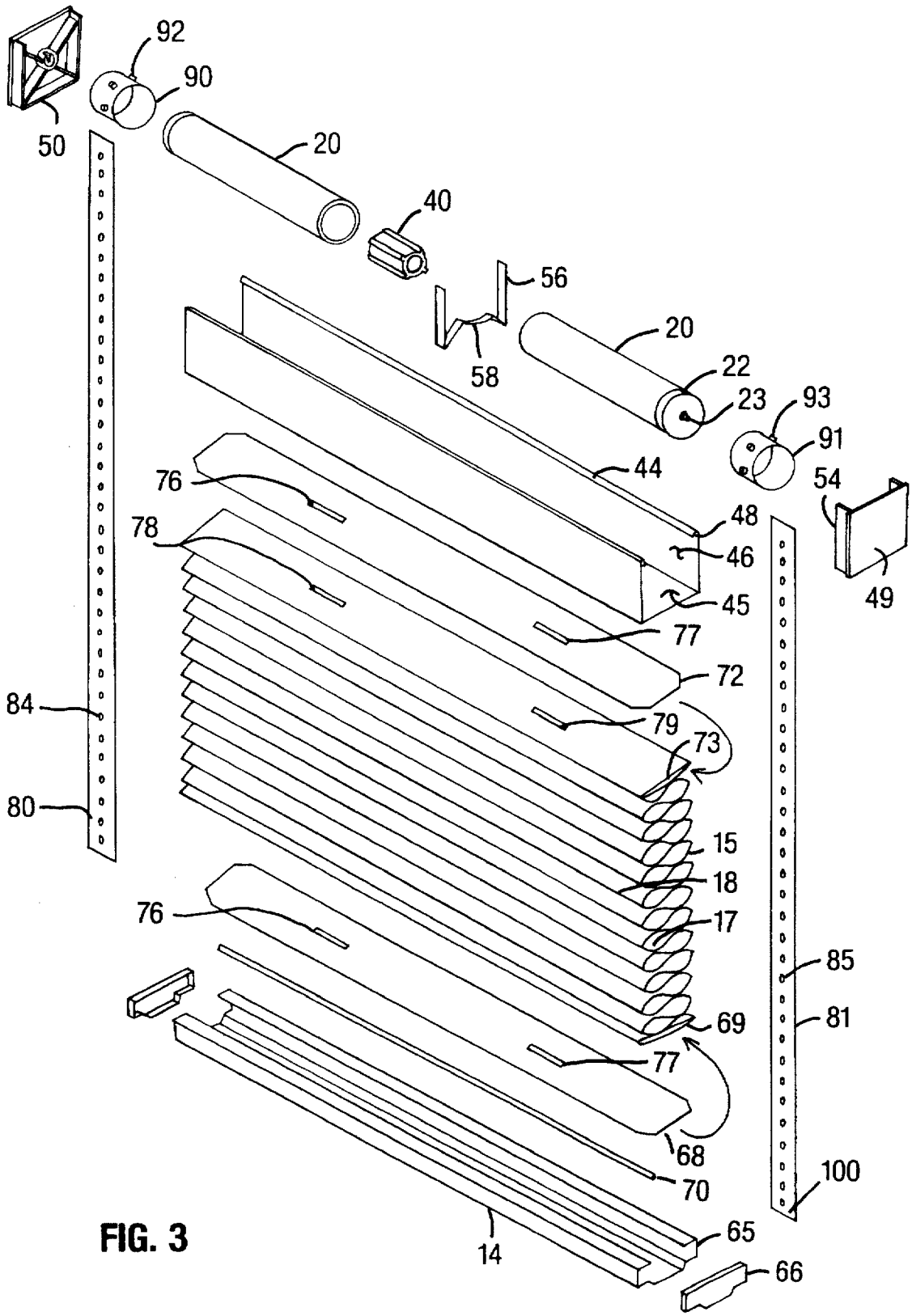
FIG. 3 is a perspective, exploded view of the invention.
Figure 7:
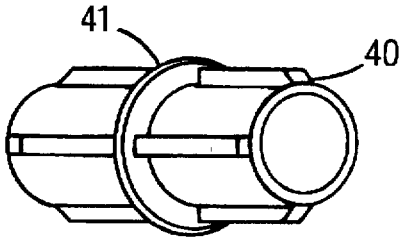
FIG. 7 is a perspective view of the spline used in the present invention.
Figure 8:
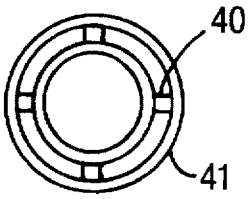
FIG. 8 is can end view of the spline shown in FIG. 7.

Referring now to FIGS. 3, 7 & 8, roller shade bar 20 in the embodiment illustrated is a long length application and comprises two standard size convoluted shade rollers with adjacent end caps removed and joined together by a spline 40. As best shown in FIG. 7, spline 40 has a cylindrical center section 41 with an outside diameter equal to the outside diameter of roller shade bar 20. When the two window shade rollers are joined together, center section 41 insures that spline 40 is inserted equally into both window shade rollers. In the embodiment illustrated, support tip stud 23 from one window shade roller with its associated end cap 22 is removed while support tip blade 24 with its spring rod 26 and spring 30 of the adjacent window shade roller is removed so that roller shade bar 20 has at one end a support tip stud 23 and at its opposite end a support tip blade 24 as in a conventional window shade roller.

Referring now to FIGS. 1–3, 6 and 12, head rail 12 is a low profile, completely self contained assembly carrying cordless window shade 10 and by which shade 10 is mounted to the frame of the window by conventional brackets (not shown) which mount to the window frame and can be attached to head rail 12 in any number of known mounting arrangements. Such mounting arrangements are well known by those skilled in the art and do not, per se, form part of the present invention and thus are not shown or described in further detail herein.

Head rail 12 includes an open ended, U-shaped, head rail extrusion 44 preferably formed from steel although it can be molded from aluminum or plastic. U-shaped extrusion 44 has a bottom base 45 from which vertically extend side rails 46 terminating at turned in or folded over top ends which form, at the top of each side rail 46, a channel or recess 48 extending the length of U-shaped extrusion 44. The length of U-shaped extrusion 44 equals or slightly exceeds the length of roller shade bar 20 from the end of support tip stud 23 to the end of support tip blade 24.

Figure 9:
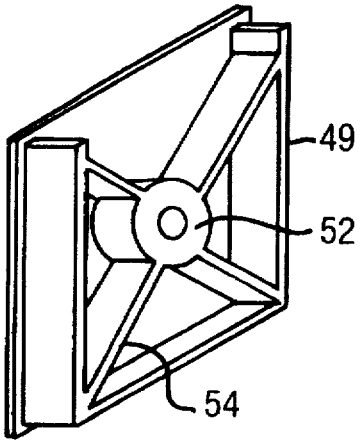
FIG. 9. is a perspective view of one of the end cap bracket supports used in the head rail of the present invention.
Figure 10:
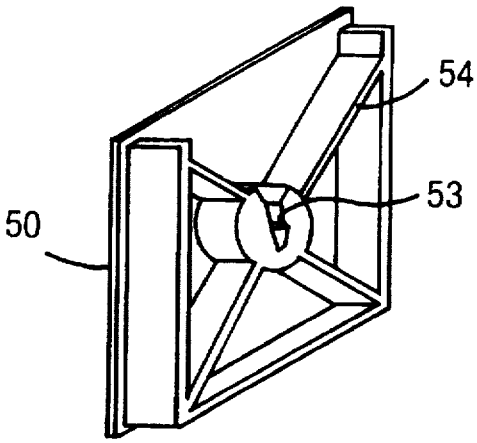
FIG. 10 is a perspective view of the other end cap bracket support used in the head rail of the present invention.
Figure 11:
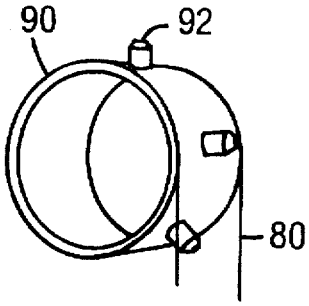
FIG. 11 is a perspective view of the spoke ring of the present invention.
Figure 12:
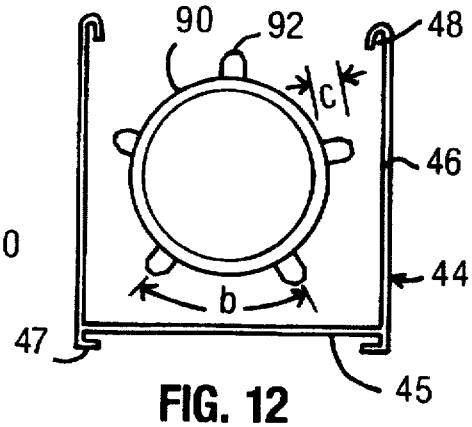
FIG. 12 is an end view of the spoke ring shown in FIG. 11.

Closing one end of U-shaped extrusion 44 is a stud support end cap 49 and closing the opposite end of U-shaped extrusion 44 is a blade support end cap 50. Stud support end cap 49, as best shown in FIG. 9, has a journal bearing 52 for rotably receiving support tip stud 23 of roller shade bar 20. Similarly, as best shown in FIG. 10, blade support end cap 50 has a slotted bracket 53 for receiving and holding in a non rotable manner support tip blade 24 of roller shade bar 20. Each end cap 49, 50 has an appropriate bracing structure 54 which permits each end cap 49, 50 to simply snap into the open ends of U-shaped extrusion 44.

Figure 6:
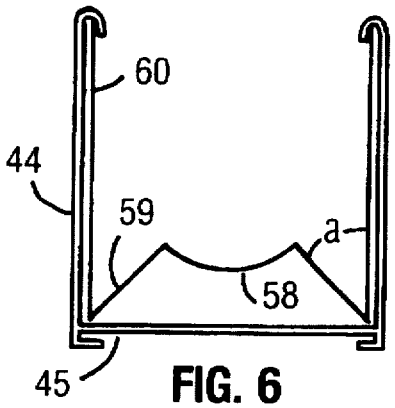
FIG. 6 is an end view of the shade roller bar support shown in FIG. 5.

Referring now to FIGS. 1–3, 5 and 6, for very long roller shade bars 20, a simple but unique bar support 56 is provided within head rail 12. It should be understood that while one bar support 56 is illustrated, a plurality of supports 56 could be provided. It should also be understood that a bar support can be provided for shorter length shades for a rigid feel effect. Bar support 56 includes a bottom cylindrical support portion 58 terminating in angular support portions 59 which, in turn, terminate in vertically extending side wall portions 60. The top edges of side wall portions 60 snap or slide into and are retained by side rail recesses 48. As best shown in FIG. 6, the dimensioning of support 56 is such that a slight clearance exists between cylindrical support portion 58 and roller shade bar 20 in a no load or free standing condition. Thus, when shade 10 is released, shade roll bar 20 is not in contact with bar support 56 and no friction develops between the two so that the tension of spring 30 is entirely and efficiently used to draw up shade fabric 15. However, should the shade be pulled down forcibly, roller shade bar 20 will bend downward and come into contact with bar support 56 to exert a downward force on cylindrical support portion 58 which will be resiliently resisted by angular support portions 50 in a gradually increasing manner. That is, a hard pull down on shade 10 firms up or rigidizes support 56 giving a "solid" or "rigidizing" feel to the operator. The rigidity of center support portion 58 is determined by the included angle shown as "a" in FIG. 6 which ideally is set at 45° although angular relationships between 37°–60° are acceptable. The concavity of center support portion 56 is set to be equal to or slightly greater than the diameter of shade roller bar 20 but preferably does not extend beyond an included angle of 20° to 60° so that high frictional forces will not develop between bar support 56 and shade roller bar 20 when shade 10 is drawn closed, even with a high force.

This is an important consideration to the commercial success of the invention. The shades to which this invention applies are relatively expensive window coverings. Cord lock, clutch activated shades are significantly more expensive but have a "solid" or "rigid" feel when operated. Convoluted shade roller bars, while inexpensive, flex and the flexing can cause the spoke rings to make contact with the inside headrail. Bar support 56 prevents this from happening and the consumer does not sense that the mechanism is "cheap" because of the "solid" feel of the shade.

Referring still to FIG. 3, bottom rail 14 is provided for attachment to the bottom of shade fabric 15. Bottom rail 14 includes an open ended, C-shaped bottom rail extrusion 65 which is closed at its ends once assembled to shade fabric 15 by end caps 66 which snap into place. A bottom support sleeve 68 typically made of a plastic material such as PVC, slides into a bottom sleeve pocket 69 formed at the bottom of shade fabric 15. Bottom support sleeve 68 is positioned within bottom sleeve pocket 69 and the shade assembled in a manner described below which includes attachment to a lift dowel 70. Bottom rail extrusion 65 is then slid over sleeve pocket 69 which contains support sleeve 68 thus closing the top of bottom rail extrusion 65 and encapsulating lift dowel 70 therein. End caps 66 are then snapped into place.

A top support sleeve 72 is likewise provided for insertion in top sleeve pocket 73 at the top of shade fabric 15. In the preferred embodiment, double faced tape is used to secure top sleeve pocket 73 to the underside of head rail base 45. Alternately, top support sleeve 72 within top sleeve pocket 73 can, similarly to bottom support sleeve 68, slide into longitudinally extending edge channels 47 extending downwardly from base 45 of head rail extrusion 44 (shown only in FIG. 12 because it is an alternative embodiment). In this manner, the top of shade fabric 15 is secured to head rail 12 and the bottom of shade fabric 15 is secured to bottom rail 14 and this is a conventional method or arrangement for attaching a cellular shade fabric to the head rail and bottom rail of a conventional, cord operated cellular shade.

As shown in FIG. 2, a first slit 74 is provided in base 45 of head rail extrusion 44 and spaced therefrom is provided an identically sized second slit 75 in head rail extrusion base 45. As shown in FIG. 3, each support sleeve 68, 72 likewise has a first slit 76 and spaced therefrom a second slit 77. Also, a first slit 78 is formed in shade fabric 15 and laterally spaced therefrom is a second slit 79 and first and second slits 78, 79 vertically extend through each polygonal call 17 of shade fabric 15 and, as illustrated, first and second shade fabric slits 78, 79 preferably are positioned to extend through the mid-point of the honeycomb matrix, i.e., preferably, at a position where polygonal shape 17*a*, 17*b* are adjacent one another so that the slits, themselves, are transparent to the honeycomb matrix. All first slits 74, 76 and 78 are vertically aligned with one another. All second slits 75, 77 and 79 are likewise vertically aligned with one another.

Extending through first slit 74, 76 and 78 is a first support tape 80 and extending through second slits 75, 77 and 79 is a second tape 81. First tape 80 has a plurality of alignment openings 84 extending along the length thereof. Second tape 81 likewise has an identical plurality of second alignment openings 85 extending along its length.

Tapes 80, 81 are polyester tapes, preferably Mylar. Tapes 80, 81 are typically transparent. When shade fabric 15 is somewhat translucent, tapes 80, 81 may be colored to have the same color as shade fabric 15 so as to be not apparent when the shade 10 is drawn. Preferably, first and second tapes 80, 81 have a width of about one inch but preferably not less than about ½". At least two (2) tapes must be used although long length shades will preferably have more than two (2) tapes. Tapes 80, 81 and their respective slits are, of course, in board of shade stud and blade tips and, for a two tape support, are typically spaced inward ¼ to ⅓ of the length of shade roller bar 20. Other spacings will suggest themselves to those skilled in the art for tape applications in excess of two.

Referring now to FIGS. 2–4 and 11–13, first and second spoke assemblies are provided for first and second tapes 80, 81 respectively. First spoke assembly comprises a first ring 90 having a plurality of spokes 92 extending radially outwardly therefrom and spaced at equal circumferential increments about first ring 90. Similarly, second spoke assembly comprises an identical second ring 91 having a like plurality of spokes 93 circumferentially spaced and extending radially outwardly therefrom. First ring 91 is slid onto roller shade bar 20 to a position vertically aligned with first slits 74, 76 and 78 and similarly, second ring 91 is likewise vertically aligned with second slits 75, 77 and 79 on shade roller bar 20. Importantly, each ring 90, 91 is orientated on shade roller bar 20 so that each spoke 92 on first ring 90 longitudinally aligns with a corresponding spoke 93 on second ring 91. To accomplish this an identifying line 95 on shade roller bar 20 is aligned with an identifying indicia line or mark 96 on first and second rings 90, 91. When first and second rings 90, 91 have been appropriately positioned on shade roller bar 20, the rings are then permanently affixed in a non rotable manner to shade roller bar 20. In the prototype, this is simply accomplished by staples 98 driven through each ring 90, 91 (plastic) into convoluted shade roller bar 20. In the commercial embodiment, it is contemplated that shade roller bar 20 would be grooved and rings 90, 91 formed with appropriate inter engaging channels, etc. which would lock rings 90, 91 in proper alignment with one another. Width of first and second rings 90, 91 equals the width of first and second tapes 80, 81. Sheaves are not required.

Figure 4:
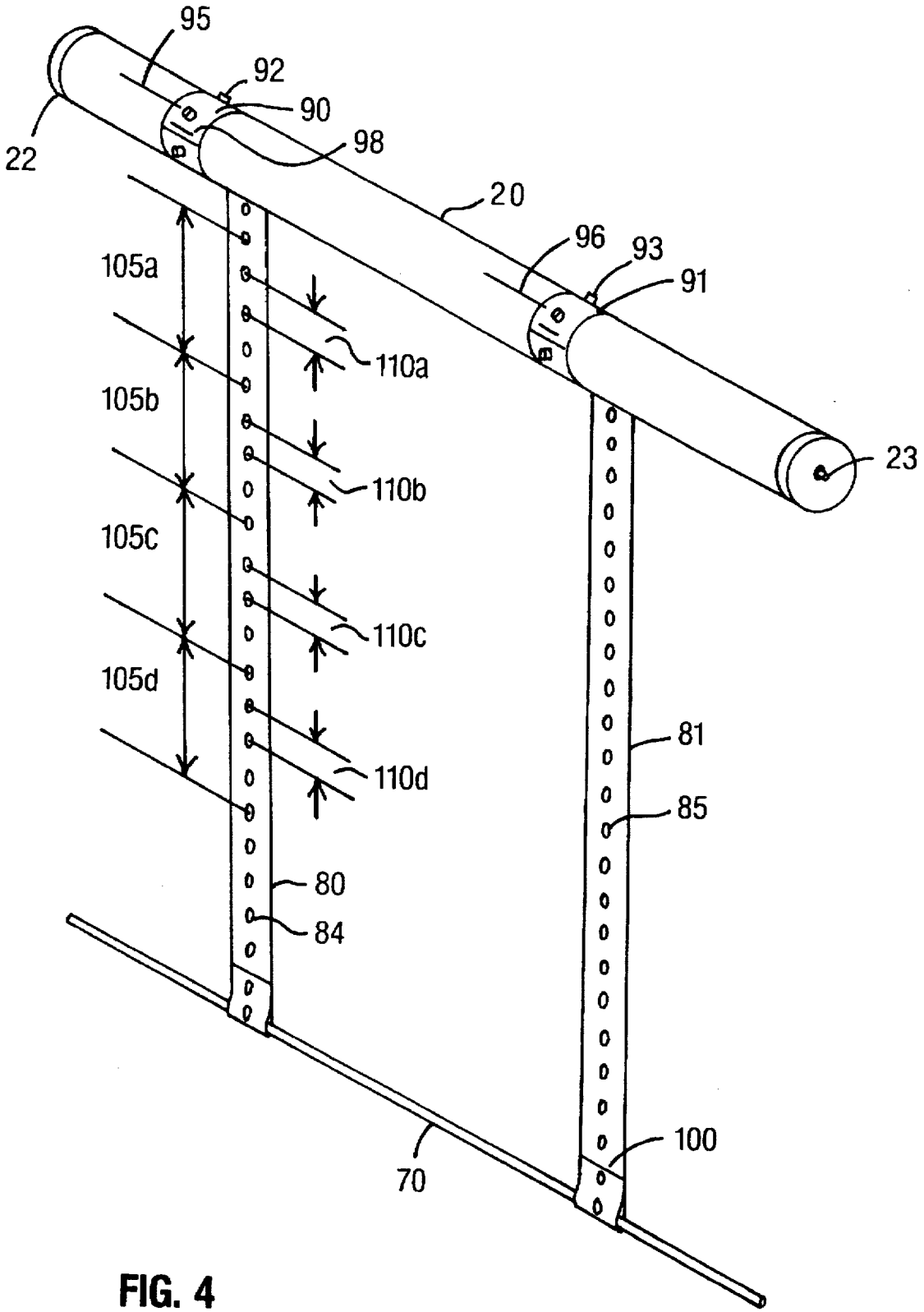
FIG. 4 is a perspective view of only the lift mechanism of the present invention.
Figure 5:
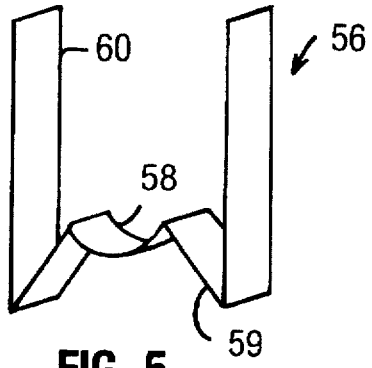
FIG. 5 is a perspective view of the shade roller bar support used in the head rail of the present invention.

As best shown in FIG. 4, the bottom 100 of first and second tapes 80, 81 wrap about lift dowel 70 and are folded back onto one another and secured by means of a double faced tape although other securing arrangements will suggest themselves to those skilled in the art. The top of each tape 80, 81 is positioned on each spoke assembly so that corresponding alignment openings 84, 85 on each tape fit over a corresponding spoke 92, 93 with shade fabric 15 fully extended. The top end of each tape 80, 81 can be the secured to its ring 90, 91 by double faced tape or otherwise. Shade 10 is thus assembled from the bottom up.

In the preferred embodiment, I have found that five (5) spokes per ring give good consistent results although in theory, at least two (2) spokes must be used. The length of spokes 92, 93, shown by dimension (c) in FIG. 12, must be long enough to hold all the plys of each tape 80, 81 when wound about its respective ring 90, 91 with shade 10 fully drawn. Thus, the length of shade fabric 10 determines the length of spokes 92, 93 and also the profile of head rail 12. Alignment openings 84, 85 must have a width slightly greater than the diameter of each spoke 92, 93 and a length slightly greater than the length of each spoke, i.e., dimension "c". The circumferential distance about each ring 90, 91 between adjacent spokes shown as dimension "b" in FIG. 12 will increase upon each successive wrap of tapes 80, 81 about rings 90, 91 and thus, the spacing between alignment openings 84, 85 for each tape will periodically increase for groupings of alignment openings equal to the number of spokes in the ring. This is diagrammatically illustrated for the preferred embodiment in FIG. 4 in which groupings of five (5) alignment openings are designated as 105*a*, 105*b*, 105*c*, 105*d*, etc., and the spacing between alignment openings 84 for alignment openings in group 105*a* is designated as 110*a* and for openings in group 105*b*, the spacing is designated 110*b*, etc. Spacings 110*a*, 110*b*, 110*c*, 110*d*, etc., gradually increase to account for the thickness of the tape as it wraps around the ring.

The shade of the present invention evolved only after a number of unsuccessful attempts. A cordless shade is, of course, not original and would be embraced by the industry if a reliable, inexpensive shade could be developed. In carrying boxes of mini blinds and cellular shades to installation sites, I noticed a significant difference in the weight between the two types of shades and drew the conclusion that the light weight of the cellular shade might lend itself to be operated by a conventional, spring wound window shade roller. Initial attempts demonstrated that the spring tension in conventional window shade rollers was adequate to raise and lower a cellular shade. However, when cords were initially used with sheaves attached to the shade roller, the bottom rail could not be maintained in alignment with the head rail. Substituting tapes for cords improved the alignment of the bottom rail and increasing the width of the tape significantly (at least to a distance of about 1") improved bottom rail alignment over that which was possible with "thin" tape. However, consistency in maintaining bottom rail alignment with the head rail was not possible even with the wide tape. After repeated observations and various modifications, it was concluded that depending upon how the bottom rail was grasped and the force at which the shade was released would result in the tapes winding themselves about their respective sheaves with an unequal force or tension which cause misalignment of the bottom rail. (Obviously, if only one tape was used, the unevenness would inherently correct itself. After all, a conventional shade has only one tape, i.e., the shade covering. However, at least two (2) tapes are required for the type of shade drawn against the headrail.) It was then found that by applying spokes to the wheel and holes in the tapes, the tapes accurately aligned with one another and the misalignment problem resulting from uneven tension during pay in or pay out, was resolved. This can perhaps be shown by reference to FIG. 13. Assuming rotation of roller shade 20 in the direction of the arrow shown, tape 80 would contact roller shade bar 20 somewhere between spokes 92*a* and 92*b* if it were simply wound about the bar. With the alignment holes and spoke arrangement described, tape 80 is engaging itself with ring 90 at spoke 92*c* which is at a position away from ring 90 and gradually sliding over the spoke until the spoke travels to the position shown as between spokes 92*b* to 92*a*. Thus, the tape is wrapping itself onto shade roller bar 20 over a longer distance which tends to dissipate or make more uniform the force of the wrap between first and second rings 90, 91. Thus, on a 1" diameter roller, 5 spokes showed an acceptable spacing producing a uniform wrap. Other spoke/spacing combinations for different sized roller shades could be used. Further, the initial contact point between tape and spoke occurs away from the curvature of roller shade bar 20.

Significantly, the bottom rail is maintained in consistent alignment with shade roller bar 20 no matter how shade 10 is abused. The head rail arrangement is uncluttered and leads to a low profile. Specifically, it should be noted that because spring 30 is contained entirely within shade roller bar 20, there are no space restrictions limiting the size or the tension of the spring.

THE ROLLER-CELL SHADE

A

The Roller-Cell Shade allows a cellular pleated fabric to be raised and lowered without the need for cords that work in conjunction with lock or clutch mechanisms. The lock and clutch systems have traditionally been used to control the raising and lowering of a shade.

The Roller-Cell Shade solves four problems:

1) Safety . . . the invention eliminates the danger of having a child get caught in or strangled by a control cord hanging down.
2) Convenience . . . often control cords are wrapped around wall-mounted cup hooks or cord cleats after the shade is adjusted. Wrapping the cord keeps it from hanging down to the floor but takes extra time and effort.
3) Aesthetics . . . many people find that cords hanging down detract from the decorative function of the cellular pleated fabric. The Roller-Cell Shade eliminates the controls which create a vertical distraction to the horizontal lines of a cellular pleated shade.
4) Consistent Alignment . . . ordinary cellular shades with lock mechanisms regularly go out of alignment, making the bottom rail uneven. The Roller-Cell Shade stays even at all times.

B

The Roller-Cell Shade operates no differently than the old style roller shades. By simply holding the bottom rail in the center and gently pulling downward, the shade can be extended to the desired length. To raise the shade, a gentle tug on the bottom rail will release the spring tension. This allows the shade to be raised to the desired height.

Other cellular shades have cords running through the fabric from the bottom to the top. However, the Roller-Cell Shade is unique in that it uses a perforated polyester tape to run through the shade instead of cords. As the shade is raised, the tape winds around gears mounted to the roller shade bar. The teeth of the gears align with the perforations in the tape. The gears ensure the tapes running through each side of the shade wind up and down with precision. This keeps the shade level at all times.

C

The Roller-Cell Shade is assembled by affixing a gear and perforated polyester tape to a standard *roller shade bar. The bar is then mounted into a headrail by resting in the end cap brackets.

The headrail, two P.V.C. support sleeves, and the cellular fabric are cut to a predetermined width and openings are punched to correspond with the position of the tape coming off the roller bar.

The support sleeves are slid into the top and bottom pleats of the fabric. This will keep those pleats rigid enough to be worked with.

The tape is then threaded through to the bottom of the fabric and double faced tape is used to affix the tape to a dowel rod. The top pleat is raised and attached to the bottom of the headrail with double faced tape. The bottom pleat is slid into the bottom rail. The end caps are snapped into place. This finishes the shade.

D

Conventional cellular shades utilize cord locks or a clutch system to raise and lower a shade. With the cord lock mechanism, cords run up through the cellular fabric across the inside of the headrail and exit out a cord lock. Based on the width of a given shade, there can be no fewer than two (2) and up to six (6) or more cords coming out of the lock mechanism. When the shade is stacked in the up position, the non-exposed cords either have to be wrapped or hung on a cup hook or cord cleat. If left alone the cords would puddle onto the floor, looking unsightly and leaving the window area unsafe to children and adults alike.

As mentioned earlier there is also the inherent problem of the cords locking in unevenly. When this happens the bottom rail will not be level. The way the locks work make this problem unavoidable.

A system which addresses this problem would be the clutch mechanism. The clutch system is considered an upgrade and carries with it a surcharge in price for the convenience of a level bottom rail. A continuous loop cord, not unlike the system used in raising and lowering a flag on a flag pole, is used in this application. Without a doubt, this is a better system, but it comes with a higher price tag and what amounts to a noose always hanging in front of the shade or window.

E

The Roller-Cell Shade has none of the disadvantages of the existing cord lock systems. As for the clutch system, the Roller-Cell Shade has no vertical distraction of cords running in front of the horizontal lines of the cellular fabric.

To sum up, the Roller-Cell Shade is the unique marriage of energy efficient cellular fabrics and the time-proven system of the roller shade.

F

Only a motorized system can provide the finished look of the Roller-Cell Shade, but again a motorized system is in a much higher price league.

The invention has been described with reference to a cellular shade. Those skilled in the art will recognize that other light weight shade fabrics can be used with the mechanism disclosed. For example, pleated shades with the tape extending through the accordion plies of the shade can obviously be utilized in the invention as well as pleated shades with applied thermal insulation. Roman and balloon type shades could likewise be employed and for those installations, the tape would simply extend through the rings on the back of the fabric through which the pulley cords now extend, That is, there would be no reason to slit the fabric. Still further, the invention has been described with reference to the prototype which modified existing, hardware components to produce the shade. Those skilled in the art will inherently recognize modifications which the normal artesian would make to the mechanism of the shade when mass produced for commercial installations. It is intended to include all such modifications and alterations insofar as they come within the scope of the present invention.

Having thus defined the invention, it is claimed:

1. A cordless cellular roller shade comprising:

a) a head rail containing a roller shade bar having a spring extending therein with one end of said spring attached to a tension bar and the opposite end secured to a shade bar end cap, said shade bar end cap having a ratchet/pawl mechanism for tensioning said spring upon shade bar rotation in one direction and releasing spring tension upon opposite shade bar rotation;

b) a bottom rail adapted to be raised and lowered relative to said head rail;

c) a pleated, cellular shade fabric extending between said head rail and said bottom rail, said cellular shade fabric having, when said shade is drawn, a honeycomb cross-section defined by a plurality of polygonal shapes vertically stacked one on top the other, said polygonal shapes collapsed into a plurality of vertically stacked, fabric plys nested between said head rail and said bottom rail when said shade is raised;

d) at least first and second transversely spaced slits extending through said polygonal shapes from the bottom to the top of said cellular shade fabric;

e) said roller shade bar having first and second transversely spaced spoke assemblies aligned with said first and second slits, respectively, each spoke assembly having a like plurality of spokes circumferentially spaced about and extending outwardly from said shade bar; and f) first and second tapes extending from said spoke assemblies through said first and second slits and secured to said bottom rail, respectively, each tape having a plurality of alignment openings spaced along its length whereby each tape is precisely wound about its respective spoke assembly to consistently maintain said bottom rail in parallel relationship with said roller shade bar when said shade is raised or lowered to any position.

2. The shade of claim 1 wherein the spacings between said alignment openings periodically increase from the top to the bottom of said tapes.

3. The shade of claim 1 wherein said spoke assemblies further include a first ring having said plurality of spokes extending therefrom and an identical ring having said like plurality of spokes extending therefrom and alignment means for affixing said rings in a precise circumferential position onto said shade bar so that each spoke on each ring is transversely aligned with a corresponding spoke on the other ring.

4. The shade of claim 3 wherein said alignment means includes transversely extending marking indicia on said roller shade bar aligned with a marking indicia on said rings.

5. The shade of claim 2 wherein said spokes number no more than five and the spacing between alignment openings equals the circumferential distance between adjacent spokes, said spacing being constant for a grouping of adjacent alignment openings equal in number to the number of said spokes, said spacing periodically increasing for each successive grouping of alignment openings to account for the thickness of said tape as said tape winds about said roller shade bar.

6. The shade of claim 1 wherein said tapes have a similar color as said cellular fabric whereby the translucent characteristics of said cellular fabric is not distorted by said tapes when said shade is drawn.

7. The shade of claim 1 wherein said shade roller bar comprises first and second tubular shade roller members joined together by an internal spline wedged into adjacent ends of said first and second tubular members whereby long length cellular shades can be assembled from standard sized window shade roller stock.

8. The shade of claim 7 wherein said spline has a center protruding cylindrical portion with an outside diameter equal to that of said roller shade bar, each tubular member contacting said spline center portion when said shade roller bar is assembled thus insuring said spline extends equally into each tubular member.

9. The shade of claim 1 wherein said head rail includes a U-shaped, open ended extrusion having a base with first and second transversely spaced slits receiving said first and second tapes, respectively; an end cap at each end of said head rail receiving a roller shade support tip and a roller shade support having a cylindrically shaped base portion for rotatably supporting said roller shade bar whereby said shade is totally assembled within an enclosed head rail which is simply secured to a window frame by brackets.

10. The shade of claim 8 wherein said head rail has side rails vertically extending from said base to turned in top ends defining a transversely extending recess, said roller shade support having side wall portions extending from said base portion and terminating at top ends retained within said recess, said cylindrically shaped base portion terminating in angular support portions extending to said side wall portions, said angular support portions providing a spring bias for said cylindrically shaped base portion.

11. The shade of claim 10 wherein said roller shade bar does not contact said central shade portion of said support unless said shade is being drawn.

12. The shade of claim 7 wherein each of said tubular shade roller members have spring means contained therein.

13. The shade of claim 7 wherein said head rail includes a U-shaped, open ended extrusion having a base with first and second transversely spaced slits receiving said first and second tapes, respectively; an end cap at each end of said head rail receiving a roller shade support tip and a roller shade support having a cylindrically shaped base portion for rotatably supporting said roller shade bar.

14. The shade of claim 1 wherein said tapes have a width less than about one half inch to insure sufficient contact area with said roller shade bar for consistent shade operation.

15. The shade of claim 1 wherein said tapes are positioned between the ends of said shade roller bar a distance not less than about one-fourth the length of said shade roller bar but not greater than about one-third the length of said shade roller bar.

16. A cordless window shade comprising:

a) a cellular shade fabric having a honeycomb, cross-sectioned configuration which expands and folds in an accordion manner when said shade is raised and lowered, said cellular fabric having first and second transversely spaced, longitudinally-extending slits through said honeycomb configuration and first and second support tapes extending, respectively, through said first and second slits;

b) a bottom rail adjacent the bottom of said cellular fabric, said tapes secured to said bottom rail;

c) a transversely extending roller shade bar adjacent the top of said cellular fabric, spring means within said shade bar for tensioning a spring when said shade bar is rotated in one direction as said shade is lowered and releasing said spring tension to cause the shade bar to rotate in the opposite direction when said shade is raised; and d) a first and second plurality of spokes extending outwardly from said roller shade bar and aligned with said first and second tapes, respectively, said first and second tapes have a plurality of alignment openings spaced along their length for receiving said spokes as said shade is raised and lowered whereby said bottom rail is maintained parallel with said roller shade bar at any drawn position of the shade.

17. The shade of claim 16 further including a first ring, said first plurality of spokes affixed to said first ring and extending therefrom and an identical second ring, said second plurality of spokes affixed to said second ring and extending therefrom, alignment means for affixing said rings in a precise circumferential position onto said shade bar so that each spoke on each ring is transversely aligned with a corresponding spoke on the other ring.

18. The shade of claim 17 wherein the spacings between said alignment openings periodically increase from the top to the bottom of said tapes.

19. The shade of claim 18 wherein said shade includes a head rail containing said roller shade bar, said head rail includes a U-shaped, open ended extrusion having a base with first and second transversely spaced slits receiving said first and second tapes, respectively; an end cap at each end of said head rail receiving a roller shade support tip and a roller shade support having a cylindrically shaped base portion for rotatably supporting said roller shade bar whereby said shade is totally assembled within an enclosed head rail which is simply secured to a window frame by brackets.

20. The shade of claim 19 wherein said head rail has side rails vertically extending from said base to turned in top ends defining a transversely extending recess, said roller shade support having side wall portions extending from said base portion and terminating at top ends retained within said recess, said cylindrically shaped base portion terminating in angular support portions extending to said side wall portions, said angular support portions providing a spring bias for said cylindrically shaped base portion.

21. The shade of claim 20 wherein said tapes have a width not less than about one half inch to insure sufficient contact area with said roller shade bar for consistent shade operation.

22. The shade of claim 21 wherein said tapes are positioned from the ends of said shade roller bar a distance not less than about one-fourth the length of said shade roller bar but not greater than about one-third the length of said shade roller bar.

23. The shade of claim 22 wherein said spokes number not more than about five and the spacing between alignment openings equals the circumferential distance between adjacent spokes, said spacing being constant for a grouping of adjacent alignment openings equal in number to the number of said spokes, said spacing periodically increasing for each successive grouping of alignment openings to account for the thickness of said tape as said tape winds about said roller shade bar.

24. The shade of claim 23 wherein said shade roller bar comprises first and second tubular shade roller members joined together by an internal spline wedged into adjacent ends of said first and second tubular members whereby long length cellular shades can be assembled from standard sized window shade roller stock.

25. A cordless shade comprising:

a) a head rail for attachment to a window sill having a roller shade bar and spring pawl means tensioned upon shade rod rotation when said shade is drawn;

b) a bottom rail;

c) a shade fabric between said top and bottom rails with the fabric arranged to fold over onto itself to form plys when said bottom rail is raised towards said top rail, and means associated with said fabric to permit said bottom rail to be connected to said head rail through said fabric;

d) first and second tapes extending through said means associated with said fabric, each tape secured at one end to said bottom rail and at its opposite end to said roller shade bar, and each tape having, along its length, a plurality of spaced alignment openings; and, e) said roller shade bar having at least a first and second transversely spaced spoke assemblies aligned with said first and second tapes, respectively; each spoke assembly having a plurality of spokes circumferentially spaced about and extending outward from said roller shade bar for insertion through said tape alignment openings when said tapes are wound about said spoke assemblies upon rotation of said shade roller bar whereby said fabric is extended or folded upon actuation of said spring means by movement of said bottom rail, said bottom rail being maintained substantially parallel with said shade rod irrespective of its vertical position.

26. The shade of claim 25 wherein said fabric is formed into polygonal cells stacked one on top of the other to form a honeycomb cross-sectioned configuration of a cellular shade and said means associated with said fabric includes first and second slits through said polygonal cells to permit said first and second tapes to vertically extend from said spokes to said bottom rail.

27. The shade of claim 25 wherein the spacings between said alignment openings periodically increase from the top to the bottom of said tapes.

28. The shade of claim 25 wherein each spoke assembly comprises a ring fitting over said shade roller bar and from which said spokes extend and said roller shade bar and said rings having transversely extending marking indicia thereon whereby said rings are aligned with one another.

29. The shade of claim 25 wherein said spokes number not more than five and the spacing between alignment openings equals the circumferential distance between adjacent spokes, said spacing being constant for a grouping of adjacent alignment openings equal in number to the number of said spokes, said spacing periodically increasing for each successive grouping of alignment openings to account for the thickness of said tape as said tape winds about said roller shade bar.

30. The shade of claim 25 wherein said tapes have a width not less than about one half inch to insure sufficient contact area with said roller shade bar for consistent shade operation.

31. The shade of claim 25 wherein said tapes are positioned from the ends of said shade roller bar a distance not less than about one-fourth the length of said shade roller bar but not greater than about one-third the length of said shade roller bar.

32. The shade of claim 25 wherein said head rail includes a U-shaped, open ended extrusion having a base with first and second transversely spaced slits receiving said first and second tapes, respectively; an end cap at each end of said head rail receiving a roller shade support tip and a roller shade support having a cylindrically shaped base portion for rotatably supporting said roller shade bar whereby said shade is totally assembled within an enclosed head rail which is simply secured to a window frame by brackets or similar attachments.

33. The shade of claim 32 wherein said head rail has side rails vertically extending from said base to turned in top ends defining a transversely extending recess, said roller shade support having side wall portions extending from said base portion and terminating at top ends retained within said recess, said cylindrically shaped base portion terminating in angular support portions extending to said side wall portions, said angular support portions providing a spring bias for said cylindrically shaped base portion.

34. The shade of claim 33 wherein said roller shade bar does not contact said central shade portion of said support unless said shade is being drawn.

* * * * *